US007722801B2

(12) United States Patent
Sato

(10) Patent No.: US 7,722,801 B2
(45) Date of Patent: May 25, 2010

(54) VACUUM CARBURIZING APPARATUS

(75) Inventor: Kenjiro Sato, Nagoya (JP)

(73) Assignee: Daido Tokushuko Kabushiki Kaisha (JP)

( * ) Notice: Subject to any disclaimer, the term of this patent is extended or adjusted under 35 U.S.C. 154(b) by 342 days.

(21) Appl. No.: 11/892,983

(22) Filed: Aug. 29, 2007

(65) Prior Publication Data

US 2008/0006346 A1 Jan. 10, 2008

(30) Foreign Application Priority Data

Mar. 3, 2006 (JP) ..... P2006-058173

(51) Int. Cl.
*C23C 8/20* (2006.01)

(52) U.S. Cl. ..... 266/252; 266/249; 266/44

(58) Field of Classification Search ..... 266/252, 266/249, 44

See application file for complete search history.

(56) References Cited

U.S. PATENT DOCUMENTS 4,191,598 A * 3/1980 Conybear et al. ..... 148/216

FOREIGN PATENT DOCUMENTS

JP 2000-001765 1/2000
JP 2002-194526 7/2002

* cited by examiner

*Primary Examiner*—Scott Kastler
(74) *Attorney, Agent, or Firm*—Bacon & Thomas, PLLC

(57) ABSTRACT

The vacuum carburizing apparatus introduces a carburizing gas into a carburizing chamber to subject the treatment material to vacuum carburizing. The vacuum carburizing apparatus comprises a carburizing chamber that houses a treatment material therein, a vacuum pump that exhausts gas from the carburizing chamber inside to obtain vacuum, a carburizing gas supply unit that supplies carburizing gas into the carburizing chamber in pulse mode, a reflux pipe which connects an intake side of the vacuum pump and an exhaust side of the vacuum pump, an opening and closing valve which is provided on the way of the reflux pipe, and a control unit which opens the opening and closing valve when a supply of the carburizing gas into the carburizing chamber is started, wherein the control unit closes the opening and closing valve when the supply ends.

2 Claims, 4 Drawing Sheets

VACUUM CARBURIZING APPARATUS

FIELD OF THE INVENTION

This invention relates to a carburizing apparatus of steels, and particularly to a carburizing apparatus which subjects steels to pulse-carburizing treatment.

BACKGROUND OF THE INVENTION

Regarding vacuum carburizing treatment of steels, in a treatment method called pulse carburizing, treatment is carried out by repeating alternately a carburization period in which carburizing gas is supplied into a carburizing chamber which houses therein a treatment material heated at a high temperature thereby to keep the carburizing chamber inside at a predetermined low vacuum degree (relatively higher pressure), and a diffusion period in which the carburizing gas is exhausted and carbon is diffused from the surface of the treatment material to the inside of the treatment material under a high vacuum degree (relatively lower pressure). According to this method, carburization can be carried out up to a narrow hole inside or a deep hole inside which the carburizing gas is difficult to permeate, and carburization can be carried out uniformly also in a uneven treatment material. Therefore, the pulse carburizing has been adopted as a carburizing method suitable for such the treatment material (Refer to, for example, Patent Document 1 and 2).

[Patent Document 1] JP-A-2000-1765

[Patent Document 2] JP-A-2002-194526

However, the above Patent Documents have the following problems. In a vacuum carburizing apparatus described in each of the above Patent Documents, a variable valve for pressure adjustment (including a movable orifice mechanism) is installed at a gas exhaust pipe which connects an exhaust outlet of a furnace to a vacuum exhaust device. And pressure controls in the carburizing chamber in the carburization period and in the diffusion period are performed by this variable valve which adjusts the flowing amount of the exhaust gas. Therefore, foreign matters such as soot and tar in the exhaust gas flowing into the gas exhaust pipe attach and accumulate to the variable valve, whereby poor operation of the variable valve is caused easily, and reliability and durability of the apparatus lower. Further, since the gas exhaust pipe has a large diameter, the size of the variable valve must be large, which causes increase of cost.

Further, heretofore, as described in the above Patent Document 1 (paragraph [0016]), there has been also used a carburizing apparatus in which the above variable valve is not provided but the vacuum exhaust device is connected directly to the exhaust outlet. This apparatus, generally, controls a rotation speed of a vacuum pump, but a range in which this apparatus can control pressure reaching on an intake side is narrow. Therefore, in case that a vacuum pump having a large exhaust speed is used as the vacuum exhaust device, as shown by a curve A in FIG. 4, shift (decompression) from pressure $P_1$ in the carburization period after the carburizing gas is introduced to pressure $P_0$ in the diffusion period is carried out quickly. However, the pressure $P_1$ in the carburization period becomes pressure of high vacuum degree which approximates the pressure $P_0$ in the diffusion period, so that permeation of the carburizing gas into the narrow hole inside in the carburizing period becomes insufficient. Further, in case that a vacuum pump having a small exhaust speed is used as the vacuum exhaust device, as shown by a curve B in FIG. 4, pressure $P_1$ in the carburization period is made a desired pressure of low vacuum degree. However, after the carburizing gas is introduced, time till the pressure $P_1$ is decreased to the pressure $P_0$ in the diffusion period becomes long, and the number of pulses is limited, so that there are problems such as occurrence of uneven carburization, prolongation of carburization treatment time, and the like.

The invention has been made in order to solve the above conventional problems, and it is an object of the invention to provide at low cost a vacuum carburizing apparatus which can obtain a desired carburization period pressure of low vacuum degree in the pulse carburizing time, and a quick shift characteristic from carburization period pressure to diffusion period pressure, and which is excellent at reliability and durability.

SUMMARY OF THE INVENTION

According to an aspect of the invention, there is provided a vacuum carburizing apparatus including; a carburizing chamber that houses a treatment material therein, a vacuum pump that exhausts gas from the carburizing chamber inside to obtain vacuum, a carburizing gas supply unit that supplies carburizing gas into the carburizing chamber in pulse mode, a reflux pipe which connects an intake side of the vacuum pump and an exhaust side of the vacuum pump, an opening and closing valve which is provided on the way of the reflux pipe, and a control unit which opens the opening and closing valve when a supply of the carburizing gas into the carburizing chamber is started, the control unit which closes the opening and closing valve when the supply ends.

DETAILED DESCRIPTION OF THE PREFERED EMBODIMENTS

Figure 1:
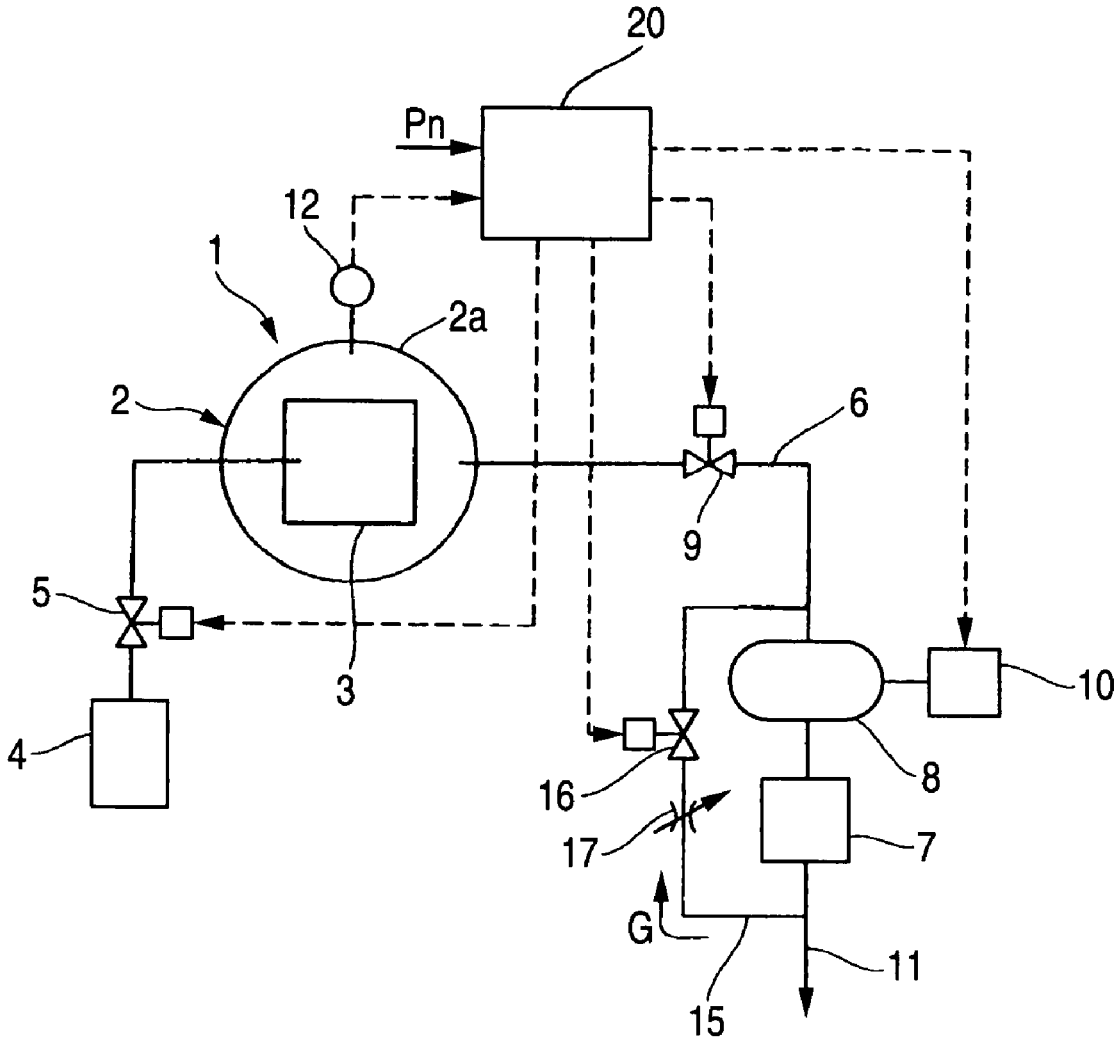
FIG. 1 is a mechanical system diagram of a vacuum carburizing apparatus, showing an example of an embodiment of this invention.
Figure 2:
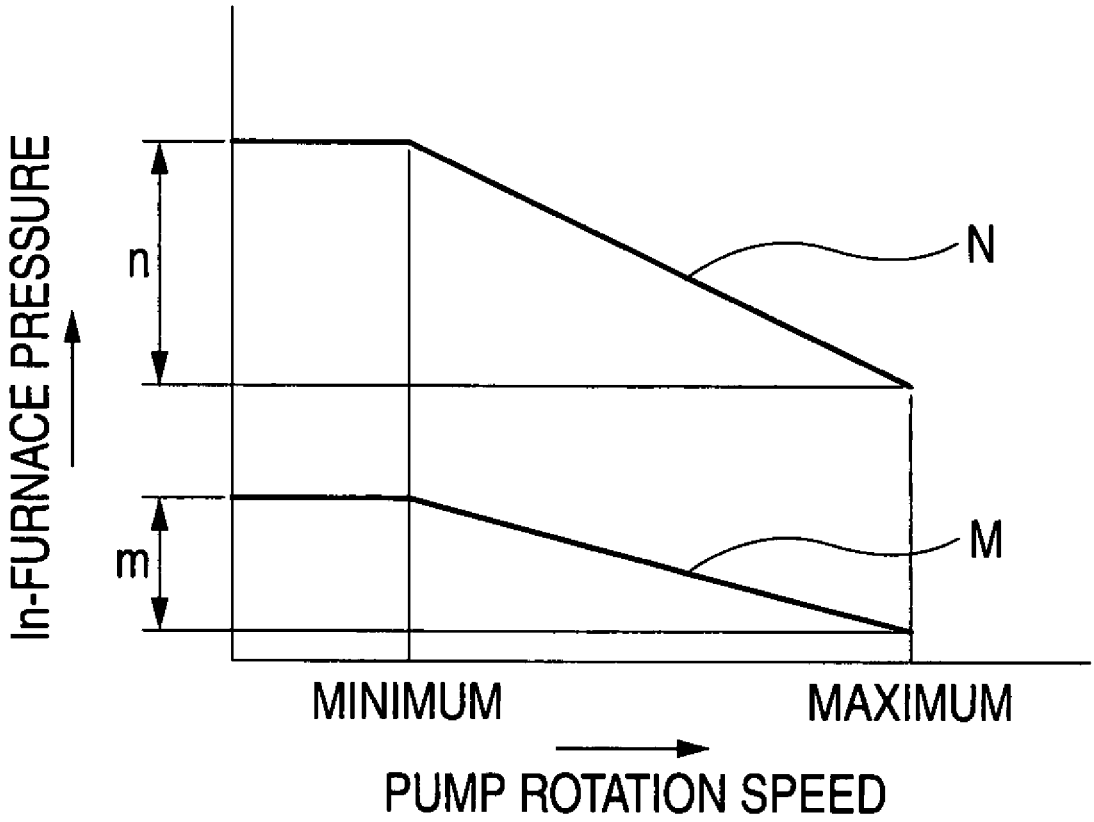
FIG. 2 is a diagram showing change of in-furnace pressure in relation to the number of pump rotations in the apparatus of FIG. 1.

An embodiment of this invention will be described below with reference to one example shown in FIGS. 1 to 3. FIG. 1 is a whole diagram of a vacuum carburizing apparatus 1, in which a reference numeral 2 is a vacuum carburizing furnace, 2*a* is a furnace body of the vacuum carburizing furnace, and 3 is a carburizing chamber which houses a treatment material therein and includes a not-shown heating device. A reference numeral 4 is a carburizing gas supply device which supplies carburizing gas into this carburizing chamber 3, and 5 is an opening and closing valve. A reference numeral 6 is an exhaust pipe connected to the furnace body 2*a* of the vacuum carburizing furnace 2. A vacuum pump for exhaust is connected to this exhaust pipe 6. The vacuum pump includes an oil-sealed rotary pump 7 and a mechanical booster pump 8 provided on the front stage side of the pump 7. A reference numeral 9 is an opening and closing valve, and 10 is an inverter for controlling rotation speed of the mechanical booster pump 8.

A reference numeral 15 is a reflux pipe which connects in a bypass manner the exhaust pipe 6 located on the intake side of the mechanical booster pump 8 and an exhaust pipe 11 of the oil-sealed rotary pump 7, 16 is an opening and closing valve provided in the middle of this reflux pipe 15, and 17 is a flowing amount adjusting valve provided similarly.

Further, a reference numeral 20 is a control device which outputs opening/closing signals to the opening and closing valve 9 in start time and end time of a full carburizing process in accordance with a control program stored in the device. And the control device 20 outputs valve opening signals to the opening and closing valve 5 of the carburizing gas supply device 4 and the opening and closing valve 16 of the reflux pipe 15 when a carburization period of pulse carburizing starts. And the control device 20 outputs valve closing signals to the both valves when the carburization period ends. Further, the control device 20, in addition to the opening and closing operations of these valves, outputs a speed control signal to the inverter 10 on the basis of a detection value of in-furnace pressure in the vacuum carburizing furnace 2 (hereinafter referred to simply as in-furnace pressure) detected by a vacuum gauge 12 and in-furnace pressure setting values Pn in the carburization period and in the diffusion period. In this way, the control device 20 controls the in-furnace pressure.

The vacuum carburizing apparatus 1 has the above vacuum exhaust system which becomes an exemplary state where the opening and closing valve 9 is opened and the opening and closing valve 16 of the reflux pipe 15 is closed, the oil-sealed rotary pump 7 and the mechanical booster pump 8 are operated. When the vacuum carburizing apparatus 1 under the exemplary state changes the rotation speed of the mechanical booster pump 8 between its minimum speed and its maximum speed, in-furnace pressure P only changes over a range m in a high vacuum degree area as shown by a curve M (which approximates to a straight line) in FIG. 2.

To the contrary, in an exemplary state where the opening and closing valve 16 is opened, as shown in FIG. 1, partial gas G in the gas exhausted from the oil-sealed rotary pump 7 is refluxed on the intake side of the mechanical booster pump 8. Therefore, the gas exhaust amount from the furnace body 2*a* of the vacuum carburizing furnace 2 decreases by the amount of the refluxed gas G, with the result that the in-furnace pressure changes over a range n in a low vacuum degree (pressure near atmospheric pressure) area as shown by a curve N in FIG. 2. Further, since the flowing amount adjusting valve 17 is installed at the reflux pipe 15 in this example, the above curve N and range n can be changed up-down by the flowing amount adjustment by means of the flowing amount adjusting valve 17.

Figure 3A:
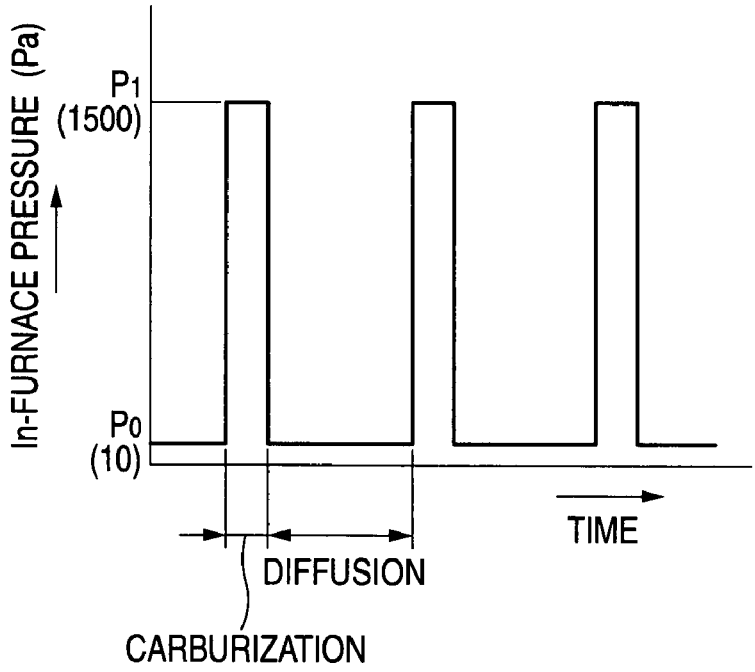
FIG. 3 is a diagram of the in-furnace pressure in the pulse carburizing time by means of the apparatus in FIG. 1.
Figure 4:
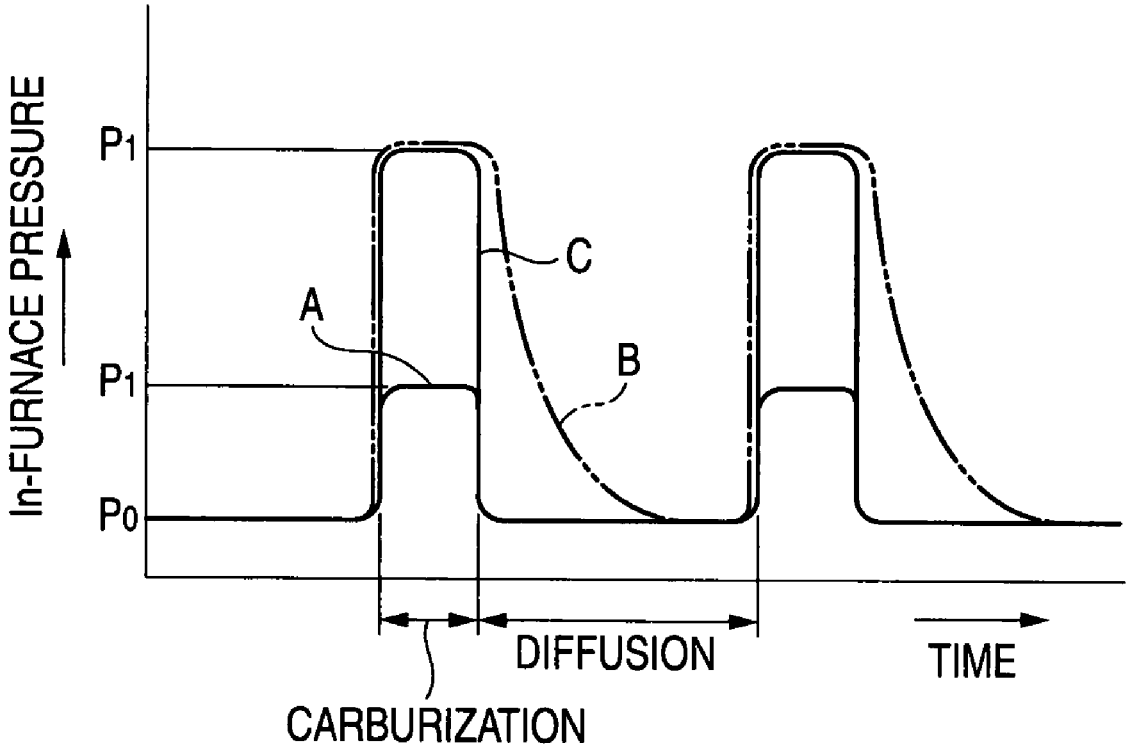
FIG. 4 is a comparative diagram of the in-furnace pressure in the pulse carburizing time between a conventional apparatus and the apparatus of the invention.

Therefore, diffusion period pressure $P_0$ of pulse carburizing is selected within the above range m, and carburization period pressure $P_1$ is selected within the above range n (specifically, the above curve N and the range n vary a little in the carburizing period due to introduction of the carburizing gas). And, as shown in FIG. 3A, it is possible to subject the treatment material that has received vacuum heating to pulse carburizing. The pulse carburizing repeats at a predetermined interval carburization at the carburization period pressure $P_1$ of the predetermined low vacuum degree by opening the opening and closing valves 5 and 16, and diffusion at the diffusion period pressure $P_0$ of the predetermined high vacuum degree by closing the opening and closing valves 5 and 16. In the figure, a numeral value put in parentheses will be described later. Further, quick shift characteristic from the carburization period pressure $P_1$ to the diffusion period pressure $P_0$ can be also obtained by selecting a pump having a suitable large exhaust speed as the vacuum pump (oil-sealed rotary pump 7 and mechanical booster pump 8) as shown by a curve C in FIG. 4, regardless of selection of the carburization period pressure.

The opening and closing operation of the opening and closing valve 16 is driven in synchronization with supply of the carburizing gas as described above. The gas G flowing in the reflux pipe 15 is comparatively clean mixed gas composed of hydrogen, nitrogen, methane, and the like, in which foreign matters such as soot and tar in the exhaust gas flowing out from the carburizing chamber 3 have been removed through the vacuum pump. Therefore, since the above foreign matters do not attach and accumulate to the opening and closing valve 16, the opening and closing valve 16 can be used over a long period of time without hindrance. Further, the reflux pipe 15 may have a bore smaller than a bore of the exhaust pipe 6, and the opening and closing valve 16 may also have small size. Therefore, the members constituting the reflux pipe 15 portion have the small size and are manufactured at low cost.

Figure 3B:
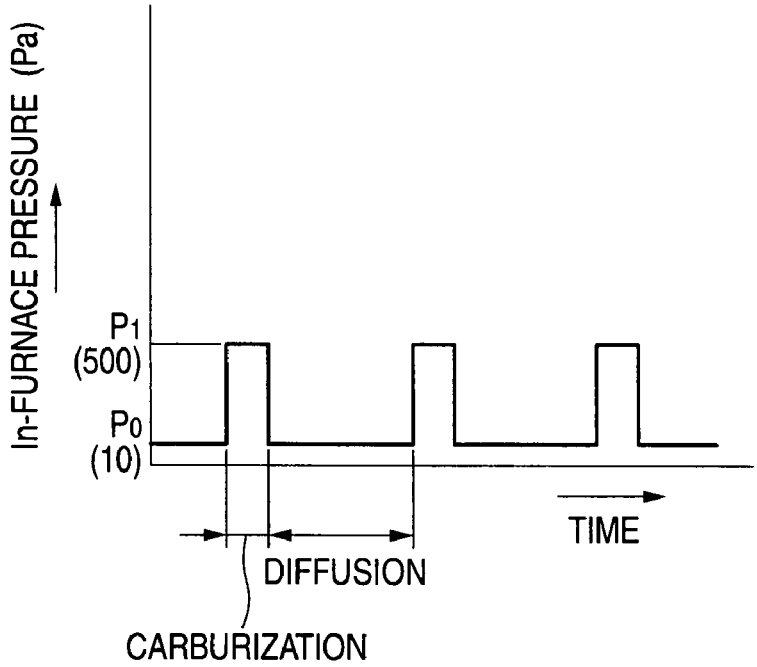

Further, FIG. 3B is an in-furnace pressure diagram in case that pulse carburizing has been performed in a state where the opening and closing valve 16 is closed for the purpose of comparison. FIG. 3B shows that the carburizing period pressure $P_1$ becomes pressure of high vacuum degree limited within the aforesaid range m. This in-furnace pressure diagram corresponds to the curve A in FIG. 4, that is, an in-furnace pressure diagram in case of the conventional apparatus having no reflux pipe 15.

Next, we show a concrete instance of pulse carburizing obtained by using the vacuum carburizing apparatus 1 (volume of carburizing chamber 3 is 5 $m^3$, exhaust speed of vacuum pump is 4 $m^3$/min, carburizing gas supply amount of carburizing gas supply device 4 is 1 $Nm^3$/h). A pulse carburizing treatment of the treatment material could be performed by a synchronizing opening/closing operation of the opening and closing valve 16 with the opening and closing valve 5, at a condition in which the carburization period pressure $P_1$ is 1500 Pa which is suitable in carburization efficiency and prevention of occurrence of soot and tar, and the like, in relation to a condition in which diffusion period pressure $P_0$ is 10 Pa in FIG. 3(*a*), with a desired cycle time (for example, carburization period is one minute, diffusion period is ten minutes). To the contrary, under the condition corresponding to the conventional device in which the opening and closing valve 16 is always closed, the carburization period pressure of high vacuum degree could be only obtained, in which the carburization period pressure $P_1$ is 500 Pa in relation to the diffusion period pressure $P_0$ is 10 Pa in FIG. 3B.

This invention is not limited to the above example. For example, as the vacuum pump, vacuum pumps of other types than the type of the above vacuum pump may be used in a single type or in combination of plural types. For example, if the vacuum pumps of the plural types are installed in the apparatus, their rotation speeds may be controlled simultaneously. Further, the flowing amount adjusting valve 17 may be omitted or may be a fixed throttle.

Above described, the vacuum carburizing apparatus of the exemplary embodiment includes a carburizing chamber that houses a treatment material therein, a vacuum pump that exhausts gas from the carburizing chamber inside to obtain vacuum, and a carburizing gas supply device that supplies carburizing gas into the carburizing chamber; and introduces the carburizing gas into the carburizing chamber in a pulse mode thereby to subject the treatment material to vacuum carburizing. Herein, this vacuum carburizing apparatus is characterized in that: an intake side and an exhaust side of the vacuum pump are connected by a reflux pipe provided with an opening and closing valve in a bypass manner; and there is provided a control unit which opens the opening and closing valve when the introduction of the carburizing gas to be introduced into the carburizing chamber in the pulse mode is started and closes the opening and closing valve when the introduction ends.

According to the thus structured vacuum carburizing apparatus, by opening the opening and closing valve when the carburizing gas is introduced into the carburizing chamber, a part of the exhaust gas from the vacuum pump is refluxed on the intake side of the vacuum pump. Therefore, the amount of the gas exhausted from the carburizing chamber decreases, and in-furnace pressure of the vacuum carburizing furnace (specifically, pressure in the carburizing chamber) increases to the low vacuum degree side (atmospheric pressure side). Pulse carburizing can be performed in combination of the diffusion period pressure in the state where the opening and closing valve is closed, which is determined by exhaust speed of the vacuum pump, with the desired carburization period pressure of the low vacuum degree, which is obtained by selecting the amount of the refluxed exhaust gas by the above reflux pipe. Further, since the vacuum pump can select its exhaust speed regardless of the carburization period pressure determined as described above, it is also possible to obtain a quick shift characteristic from the carburization period pressure to the diffusion period pressure.

In the gas flowing in the above reflux pipe, foreign matters such as soot and tar are removed through the vacuum pump from the exhaust gas flowing from the carburizing chamber. Therefore, the opening and closing valve has no attachment and accumulation of these foreign matters and can be used over a long period of time without causing failure or the like. Further, the reflux pipe in which a part of the exhaust gas flows as described above may have a bore smaller than a bore of the exhaust pipe (gas exhaust pipe) of the vacuum carburizing furnace to which the vacuum pump is connected, and the opening and closing valve of this reflux pipe may also have small size. Therefore, compared with the case where the variable valve is installed at the above exhaust pipe, the components can be miniaturized and the cost is reduced.

As described above, according to the exemplary embodiment, it is possible to obtain at low cost a vacuum carburizing apparatus which can obtain a desired carburization period pressure of low vacuum degree in the pulse carburizing time, and a quick shift characteristic from the carburization period pressure to diffusion period pressure, and which is excellent at reliability and durability.

While the present invention has been described in detail and with reference to specific embodiments thereof, it will be apparent to one skilled in the art that various changes and modifications can be made therein without departing from the spirit and scope thereof.

What is claimed is:

1. A vacuum carburizing apparatus which introduces a carburizing gas into a carburizing chamber to subject an article to vacuum carburizing, comprising:

a carburizing chamber that houses the article therein, a vacuum pump that exhausts gas from the carburizing chamber to obtain vacuum, a carburizing gas supply unit that supplies carburizing gas into the carburizing chamber in pulse mode, a reflux pipe which connects an intake side of the vacuum pump and an exhaust side of the vacuum pump, an opening and closing valve which is located in the reflux pipe, and a control unit which opens the opening and closing valve when a supply of the carburizing gas into the carburizing chamber is started and closes the opening and closing valve when the supply ends, and a flow amount adjusting valve which is located in the reflux pipe, the flow amount adjusting valve adjusting an amount of carburizing gas flowing back to the intake side of the vacuum pump.

2. A method for carburizing an article, including:

a step in which a carburizing gas is supplied into a carburizing chamber in pulse mode;

a step in which a vacuum pump exhausts gas from the carburizing chamber to obtain vacuum;

a step in which a opening and closing valve, which is located in a reflux pipe that connects an intake side of the vacuum pump and an exhaust side of the vacuum pump, is opened when a supply of a carburizing gas into the carburizing chamber is started;

a step in which the opening and closing valve is closed when the supply of a carburizing gas into the carburizing chamber ends; and a step in which an amount of carburizing gas flowing back to the intake side of the vacuum pump is adjusted by operation of a flow amount adjusting valve located in the reflux pipe.

* * * * *